US010827275B2

(12) United States Patent
Xiao

(10) Patent No.: US 10,827,275 B2
(45) Date of Patent: Nov. 3, 2020

(54) MICRO-SPEAKER

(71) Applicant: AAC Technologies Pte. Ltd., Singapore (SG)

(72) Inventor: Bo Xiao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,189

(22) Filed: Jul. 29, 2019

(65) Prior Publication Data

US 2020/0045460 A1 Feb. 6, 2020

(30) Foreign Application Priority Data

Aug. 1, 2018 (CN) ..... 2018 2 1237332 U

(51) Int. Cl.

| | |
|---|---|
| ***H04R 9/06*** | (2006.01) |
| ***H04R 1/02*** | (2006.01) |
| ***H04R 9/02*** | (2006.01) |
| ***H04R 7/18*** | (2006.01) |

(52) U.S. Cl.

CPC ..... *H04R 9/06* (2013.01); *H04R 1/02* (2013.01); *H04R 7/18* (2013.01); *H04R 9/025* (2013.01); *H04R 2400/11* (2013.01); *H04R 2499/11* (2013.01)

(58) Field of Classification Search

CPC . H04R 1/02; H04R 7/18; H04R 7/127; H04R 9/025; H04R 9/06; H04R 2307/204; H04R 2400/11; H04R 2499/11

See application file for complete search history.

(56) References Cited

U.S. PATENT DOCUMENTS

| | | | | |
|---|---|---|---|---|
| 9,344,804 | B2 * | 5/2016 | Chen | H04R 9/02 |
| 10,154,349 | B2 * | 12/2018 | Li | H04R 9/06 |
| 2018/0041844 | A1 * | 2/2018 | Shan | H04R 9/04 |

* cited by examiner

*Primary Examiner* — Brian Ensey
(74) *Attorney, Agent, or Firm* — W&G Law Group LLP

(57) ABSTRACT

A micro-speaker is provided. The micro-speaker includes a vibration unit; and a fixed unit. The vibration unit includes: a diaphragm; a voice coil located below the diaphragm and configured to drive the diaphragm to vibrate and emit sound; and a flexible circuit board connecting the diaphragm with the voice coil. The diaphragm includes a dome in its middle and a voice membrane extending from an edge of the dome. The flexible circuit board is supported at a side of the voice membrane close to the voice coil. The flexible circuit board comprises a first fixed portion facing away from the dome and a second fixed portion formed into one piece with the dome. The first fixed portion is fixed to the fixed unit and fixed at a side of the voice membrane facing away from the dome.

10 Claims, 5 Drawing Sheets

MICRO-SPEAKER

TECHNICAL FIELD

The present disclosure relates to the field of electric-acoustic conversion technologies, and in particular, to a micro-speaker.

BACKGROUND

In order to adapt to the development of miniaturization and multi-functionalization of various audio equipment and information communication equipment, it is required that the micro-speakers used in such equipment further tend to miniaturization, so that the micro-speakers and other peripheral components are more compact. In particular, with the development of thin and light mobile phones, quality requirements for the micro-speakers used therein are also increasing.

The micro-speaker includes a vibration unit. In the related art, a voice membrane, a dome, a flexible circuit board and a voice coil in the vibration unit are arranged in a top-down stacking manner. However, the flexible circuit board and the dome are glued together by a binder, so that there is a risk of separating the dome and the flexible circuit board in the reliability test and the environmental test, and there is a risk of glue-overflowing and glue-breaking during a gluing process, thus affecting the performance and yield of the product.

Therefore, it is necessary to provide a new micro-speaker to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

Figure 1:
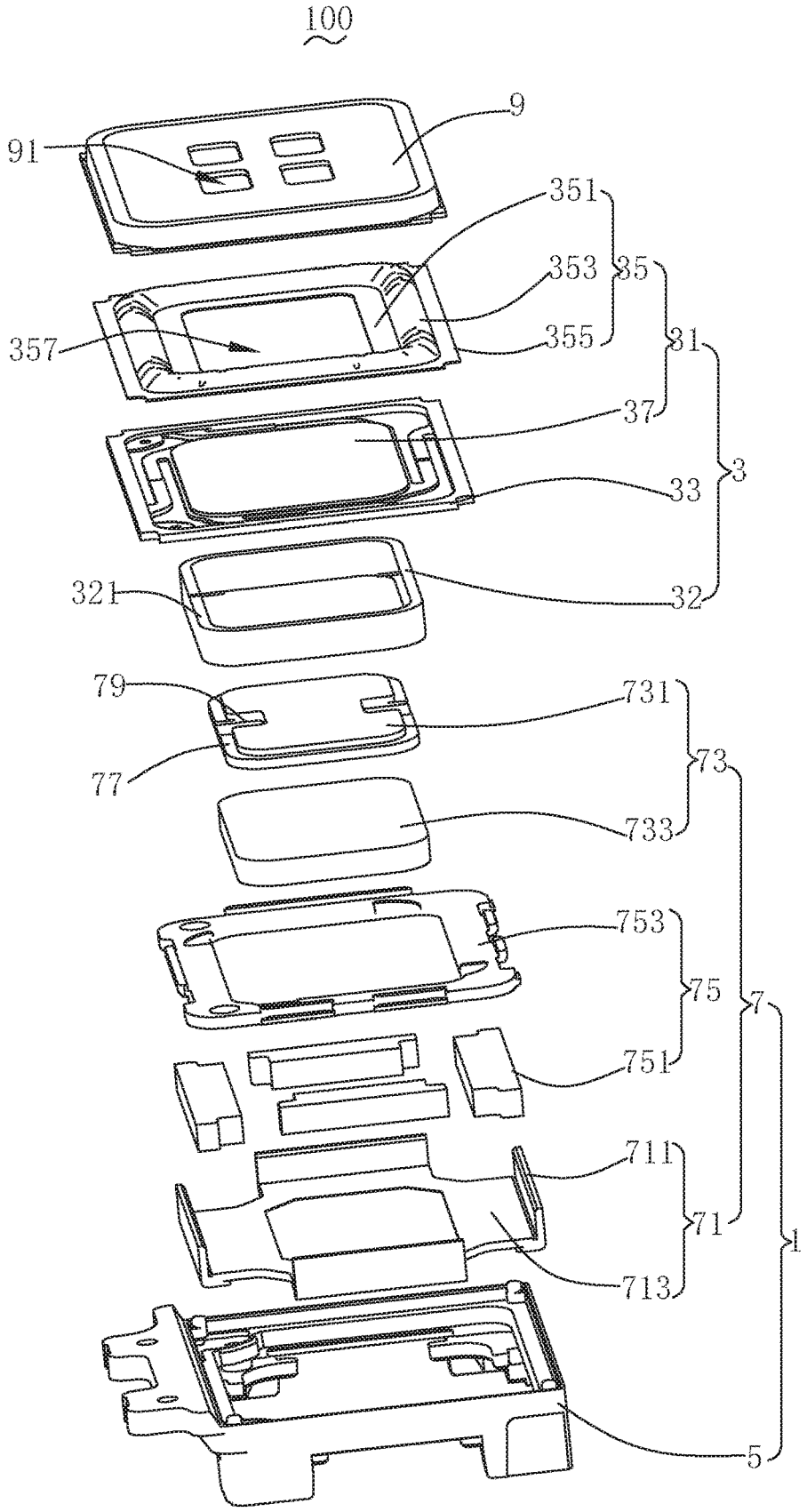
FIG. 1 is a perspective exploded view of a micro-speaker according to an embodiment of the present disclosure.
Figure 2:
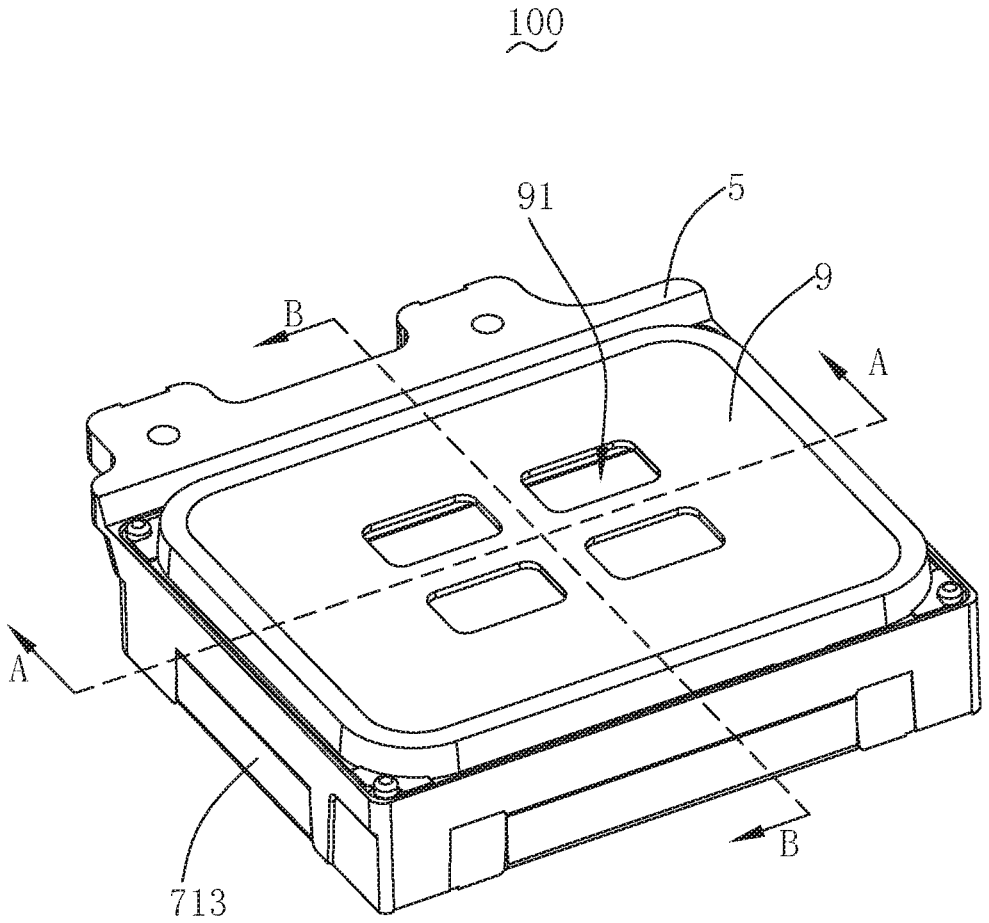
FIG. 2 is a perspective view of the micro-speaker shown in FIG. 1 after being assembled.
Figure 3:
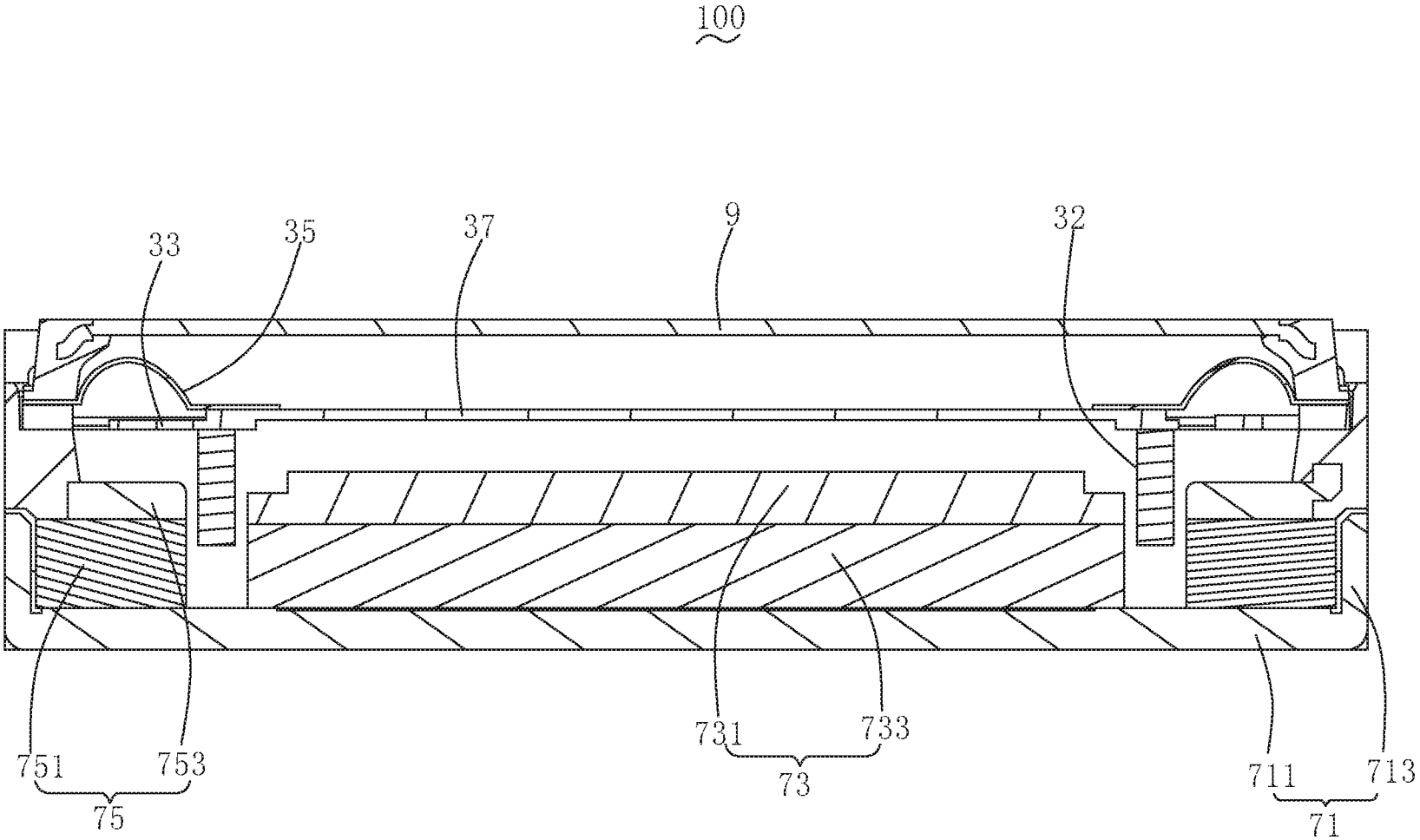
FIG. 3 is a cross-sectional view of the micro-speaker of FIG. 2 taken along line A-A.
Figure 4:
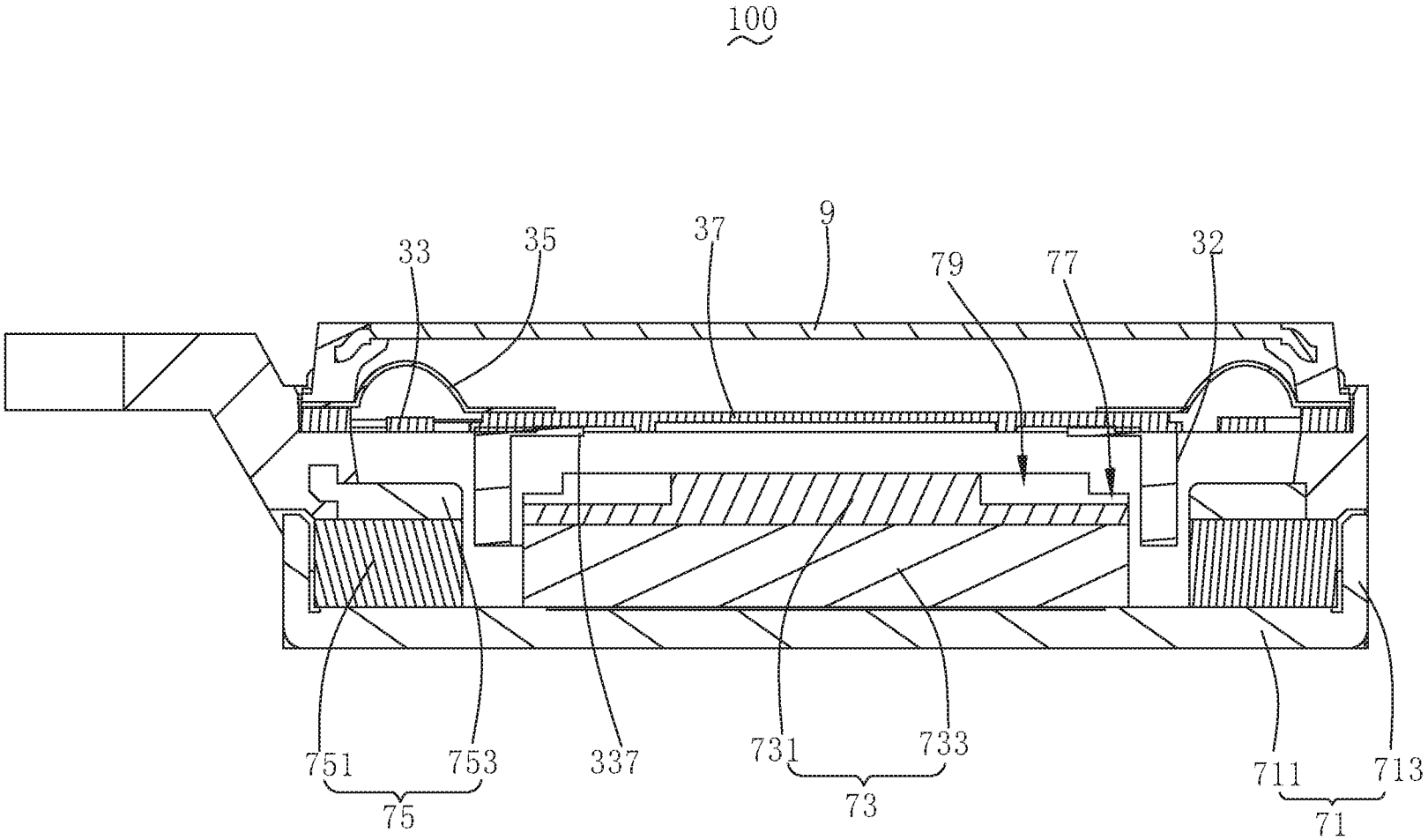
FIG. 4 is a cross-sectional view of the micro-speaker of FIG. 2 taken along line B-B.
Figure 5:
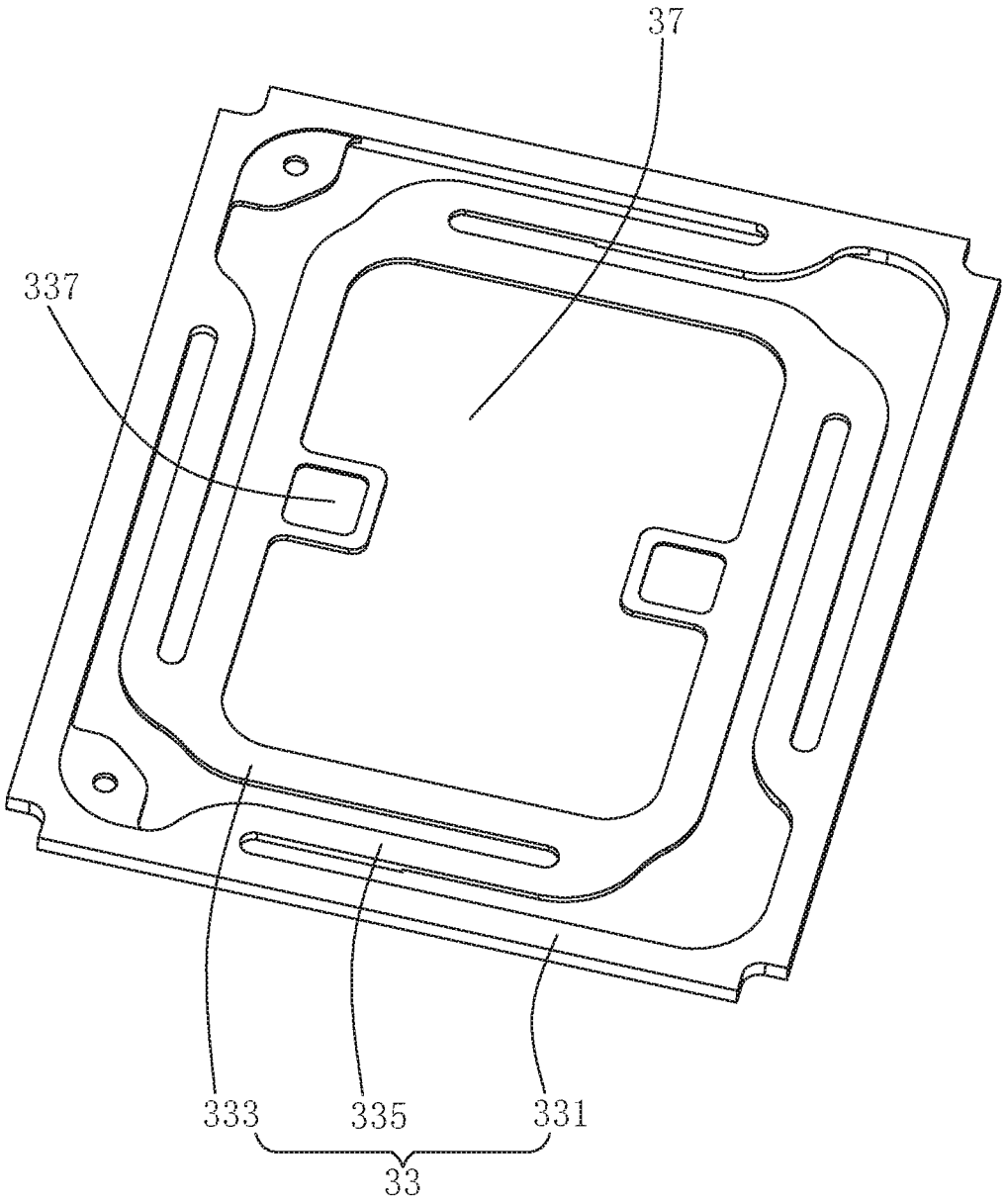
FIG. 5 is a structural schematic diagram of a flexible circuit board and a dome at another angle in the micro-speaker shown in FIG. 1.

The present disclosure will be further illustrated with reference to the accompanying drawings and the embodiments.

As shown in FIGS. 1 to 5, a micro-speaker 100 includes a fixed unit 1 and a vibration unit 3. The fixed unit 1 includes a holder 5 having a receiving space and a magnetic circuit unit 7 received in the holder 5 to drive the vibration unit 3.

The vibration unit 3 includes a diaphragm 31, a voice coil 32 located below the diaphragm 31 and driving the diaphragm 31 to vibrate and emit sound, and a flexible circuit board 33 connecting the diaphragm 31 with the voice coil 32. The diaphragm 31 includes a voice membrane 35 and a dome 37. The dome 37 is located in the middle, and the voice membrane 35 extends from an edge of the dome 37. The flexible circuit board 33 is supported at a side of the voice membrane 35 close to the voice coil 32. The flexible circuit board 33 includes a first fixed portion 331 facing away from the dome 37 and a second fixed portion 333 formed into one piece with the dome 37. The first fixed portion 331 is fixed to the fixed unit 1 and fixed to a side of the voice membrane 35 facing away from the dome 37.

The first fixed portion 331 is fixed to the holder 5 of the fixed unit 1. The first fixed portion 331 is spaced apart from the second fixed portion 333. The flexible circuit board 33 further includes an elastic connection portion 335 connecting the first fixed portion 331 with the second fixed portion 333. The voice coil 32 is connected to an external circuit through the flexible circuit board 33. After the voice coil 32 is energized, the voice coil 32 may vibrate under the magnetic field of the magnetic circuit unit 7. At the same time, the voice coil 32 drives the diaphragm 31 and the flexible circuit board 33 to vibrate together.

The dome 37 is a polymer dome. In this embodiment, the polymer dome is a membrane layer including polyetheretherketone (PEEK) and/or thermoplastic polyurethane (TPU). When being manufactured, the polymer dome and the second fixed portion 333 of the flexible circuit board 33 may be formed into one piece by an overmolding process.

In this embodiment, the first fixed portion 331 and/or the second fixed portion 333 are in a ring structure. As shown in FIG. 1, each of the first fixed portion 331 and the second fixed portion 333 is in a ring structure. The second fixed portion 333 encloses a through hole. The dome 37 covers the through hole.

The second fixed portion 333 extends along a direction facing away from the first fixed portion 331 to form a pad 337 connected to a lead wire of the voice coil 32. The pad 337 is located at a side of the dome 37 close to the voice coil 32. In the embodiment, the pad 337 is located on a short axis side of the second fixed portion 333.

The voice coil 32 has a rectangular structure as a whole. The voice coil 32 includes an upper surface 321 facing right towards the diaphragm 31. The upper surface 321 is fixed to the second fixed portion 333.

The voice membrane 35 includes a flat portion 351, a suspension portion 353 extending outward from the flat portion 351, and a joint portion 355 surrounding the suspension portion 353. The flat portion 351 is connected to the dome 37. The suspension portion 353 opens toward the flexible circuit board 33 to avoid the elastic connection portion 335. The joint portion 355 is fixed to the first fixed portion 331 of the flexible circuit board 33, so that the voice membrane 35 and the flexible circuit board 33 are fixed to the holder 5 of the fixed unit 1. In this embodiment, the flat portion 351 has a center-cut hole 357. The dome 37 covers the center-cut hole 357. In other embodiments, the flat portion 351 may not have a center-cut hole, that is, the flat portion 351 is an intact flat plate structure.

The magnetic circuit unit 7 includes a yoke 71, a first magnet portion 73, and a second magnet portion 75. The yoke 71 is fixed and held at the holder 5. The first magnet portion 73 and the second magnet portion 75 are bonded to the yoke 71. The second magnet portion 75 is provided to surround the first magnet portion 73 and forms a magnetic gap with the first magnet portion 73. One end of the voice coil 32 facing away from the flexible circuit board 33 is inserted into the magnetic gap so that the voice coil 32 may vibrate under the action of the magnetic field of the magnetic circuit unit 7 after the voice coil 32 is energized.

The yoke 71 includes a bottom plate 711, and side plates 713 formed by extending from four sides of the bottom plate 711 while being bent towards the diaphragm 31. The side plate 713 is fixed to the holder 5.

The first magnet portion 73 faces right towards the dome 37. The first magnet portion 73 is recessed to form a give-way portion 77 and an avoiding portion 79. The give-way portion 77 and the avoiding portion 79 are formed by recessing from a surface of the first magnet portion 73 facing the dome 37 along a direction facing away from the dome 37. The give-way portion 77 faces right towards the second fixed portion 333 to avoid the second fixed portion 333. The avoiding portion 79 faces right towards the pad 337 to avoid the pad 337.

The first magnet portion 73 includes a pole plate 731 facing right towards the dome 37 and a main magnet 733 provided at a side of the pole plate 731 facing away from the dome 37. The give-way portion 77 and the avoiding portion 79 are formed on the pole plate 731.

The second magnet portion 75 includes an auxiliary magnet 751 and a splint 753. The auxiliary magnet 751 is bonded to the bottom plate 711 and surrounds the main magnet 733. The splint 753 is fixed and held at the holder 5, and is stacked on the auxiliary magnet 751. The splint 753 is made of a permeability material. The splint 753 has a through hole. The pole plate 731 is located in the through hole of the splint 753 and is in a same plane as the splint 753.

The micro-speaker 100 further includes a cover 9 covering the holder 5. The cover 9 is provided with an outlet 91. The outlet 91 is used as a channel for outputting the sound generated by vibration of the diaphragm 31.

With the micro-speaker 100 provided by the present disclosure, the dome 37 is formed into one piece with the flexible circuit board 33, thereby avoiding the risk of glue-overflowing and glue-breaking in the gluing process caused by glue bonding while improving the connection strength between them, thereby avoiding the risk of separation between them. Meanwhile, the assembly process can be simplified, the material cost can be reduced and the efficiency can be improved.

The above are only preferred embodiments of the present disclosure. Here, it should be noted that those skilled in the art can make modifications without departing from the inventive concept of the present disclosure, but these shall fall into the protection scope of the present disclosure.

What is claimed is:

1. A micro-speaker, comprising:

a vibration unit; and a fixed unit, wherein the vibration unit comprises:

a diaphragm;

a voice coil located below the diaphragm and configured to drive the diaphragm to vibrate and emit sound; and a flexible circuit board connecting the diaphragm with the voice coil, wherein the diaphragm comprises a dome in its middle and a voice membrane extending from an edge of the dome, the flexible circuit board is supported at a side of the voice membrane close to the voice coil, the flexible circuit board comprises a first fixed portion facing away from the dome and a second fixed portion formed into one piece with the dome, and the first fixed portion is fixed to the fixed unit and fixed at a side of the voice membrane facing away from the dome;

the second fixed portion extends in a direction facing away from the first fixed portion to form a pad connected to a lead wire of the voice coil, and the pad is located at a side of the dome close to the voice coil; and the fixed unit comprises a first magnet portion facing right towards the dome, and the first magnet portion is recessed to form a give-way portion and an avoiding portion, the give-way portion and the avoiding portion are formed by recessing from a surface of the first magnet portion facing the dome along a direction facing away from the dome, Wherein the give-way portion faces right towards the second fixing portion so as to avoid the second fixed portion, and the avoiding portion faces right towards the pad so as to avoid the pad.

2. The micro-speaker as described in claim 1, wherein the first fixed portion is spaced apart from the second fixed portion, and the flexible circuit board further comprises an elastic connection portion connecting the first fixed portion with the second fixed portion.

3. The micro-speaker as described in claim 2, wherein each of the first fixed portion and/or the second fixed portion is in a ring structure.

4. The micro-speaker as described in claim 3, wherein the second fixed portion encloses a through hole, and the dome covers the through hole.

5. The micro-speaker as described in claim 2, wherein the voice coil comprises an upper surface facing right towards the diaphragm, and the upper surface is fixed to the second fixed portion.

6. The micro-speaker as described in claim 1, wherein the first magnet portion comprises a pole plate facing right towards the dome and a main magnet provided at a side of the pole plate facing away from the dome, and the give-way portion and the avoiding portion are formed on the pole plate.

7. The micro-speaker as described in claim 1, wherein the voice membrane comprises a flat portion, a suspension portion extending outward from the flat portion, and a joint portion surrounding the suspension portion, the flat portion is connected to the dome, the suspension portion opens toward the flexible circuit board, and the joint portion is fixed to the first fixed portion.

8. The micro-speaker as described in claim 7, wherein the flat portion has a center-cut hole, and the dome covers the center-cut hole.

9. The micro-speaker as described in claim 1, wherein the dome is a polymer dome.

10. The micro-speaker as described in claim 9, wherein the polymer dome is a membrane layer comprising polyetheretherketone resin and/or thermoplastic polyurethane elastomer rubber.

* * * * *